United States Patent [19]

Swisher et al.

[11] Patent Number: 4,655,727

[45] Date of Patent: Apr. 7, 1987

[54] TOY VEHICLE

[75] Inventors: Gary R. Swisher, Hermosa Beach; Keith G. Meggs, Torrance, both of Calif.

[73] Assignee: Mattel, Inc., Hawthorne, Calif.

[21] Appl. No.: 787,546

[22] Filed: Oct. 15, 1985

[51] Int. Cl.[4] ..... A63H 33/30

[52] U.S. Cl. ..... 446/470; 446/95; 446/471

[58] Field of Search ..... 446/470, 471, 465, 428, 446/432, 434, 466, 93–95, 427, 462, 469

[56] References Cited

U.S. PATENT DOCUMENTS

| | | | |
|---|---|---|---|
| D. 260,792 | 9/1981 | Jones et al. . | |
| 2,277,455 | 3/1942 | Rexford | 446/428 |
| 3,039,229 | 6/1962 | Van Cleemput | 446/434 |
| 4,457,099 | 7/1984 | Kozuka et al. . | |

FOREIGN PATENT DOCUMENTS

| | | | |
|---|---|---|---|
| 1265599 | 5/1961 | France | 446/428 |

*Primary Examiner*—Mickey Yu

*Attorney, Agent, or Firm*—Ronald Goldman; Melvin A. Klein; Daniel F. Sullivan

[57] ABSTRACT

A toy vehicle having a base portion; a top portion; and a mechanical arrangement linking the base portion to the top portion for causing the top portion to move to a number of different positions with respect to the base portion, the aforementioned arrangement including a pair of pivoting axles, receptacles for pivotably fixing the axles at selected positions adjacent the base portion, a pair of arms extending from each of the axles, each of the arms having an end, and an arrangement pivotably fixing the ends of the arms extending from each axle to pivot at selected positions adjacent the top portion.

5 Claims, 3 Drawing Figures

TOY VEHICLE

BACKGROUND OF THE INVENTION

This invention relates to toy vehicles and, more particularly, to toy vehicles capable of displaying unusual mechanical movements.

Over the years a number of toy lines have been developed which depict various fantastic settings. Some of these settings involve outerspace, imagined planets, and various alien creatures supposedly encountered thereon. Other such settings depict undersea worlds, imagined worlds of the ancient past, battlegrounds, and robotic creatures.

In many of these settings, vehicles having unusual exterior features or surprising mechanical actions are included. For example, U.S. No. Des. 260,792, issued Sept. 15, 1981, to Jones, et al, shows the ornamental design for a futuristic toy vehicle which might be used in such a setting. U.S. Pat. No. 4,457,099, issued July 3, 1984, to Kozuka, et al, discloses a toy vehicle which has a particular rising motion which enlarges its body in a vertical direction and might also be utilized in one of the aforedescribed settings.

However, no matter how many vehicles having unusual exteriors or surprising mechanical characteristics have been previously devised, children are always interested in playing with toys having new external appearances and unexpected mechanical actions. Furthermore, manufacturers are always desirous of producing toy vehicles which appeal to children, are hardy in use, and are inexpensive to manufacture.

SUMMARY OF THE INVENTION

It is therefore an object of this invention to provide an improved toy vehicle which may be adapted to utilize any of a number of different exterior appearances while providing a unique and unusual form of vehicular motion.

This and other objects of the invention are accomplished by a toy vehicle which normally assumes a crouching position from which it expands upwardly and in a forward direction. Such a motion appears to emulate the crouch and springing motion of a predator thereby lending the toy vehicle a substantial air of menace. The preferred embodiment utilizes a parallelogram mechanical arrangement positioned between separate upper and lower body portions to implement the movement. The upper body portion is conveniently constructed to utilize any of a number of different exterior body shells thereby to provide a variety of outward appearances and to lower overall production costs of a line of such toy vehicles.

BRIEF DESCRIPTION OF THE DRAWINGS

This and other objects and advantages of the invention will be obvious from the detailed description taken together with the drawings in which.

DESCRIPTION OF THE PREFERRED EMBODIMENT

Figure 1:
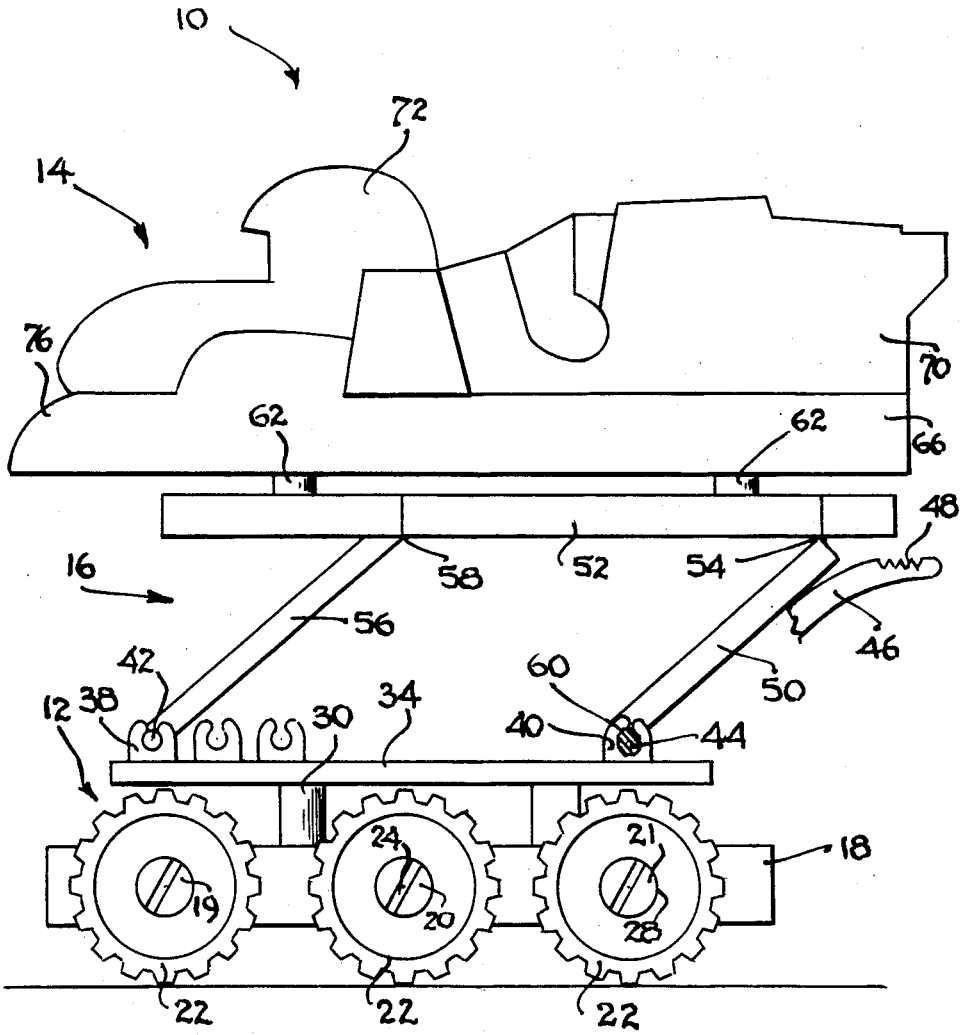
FIG. 1 is a side view of a toy vehicle constructed in accordance with the invention.
Figure 2:
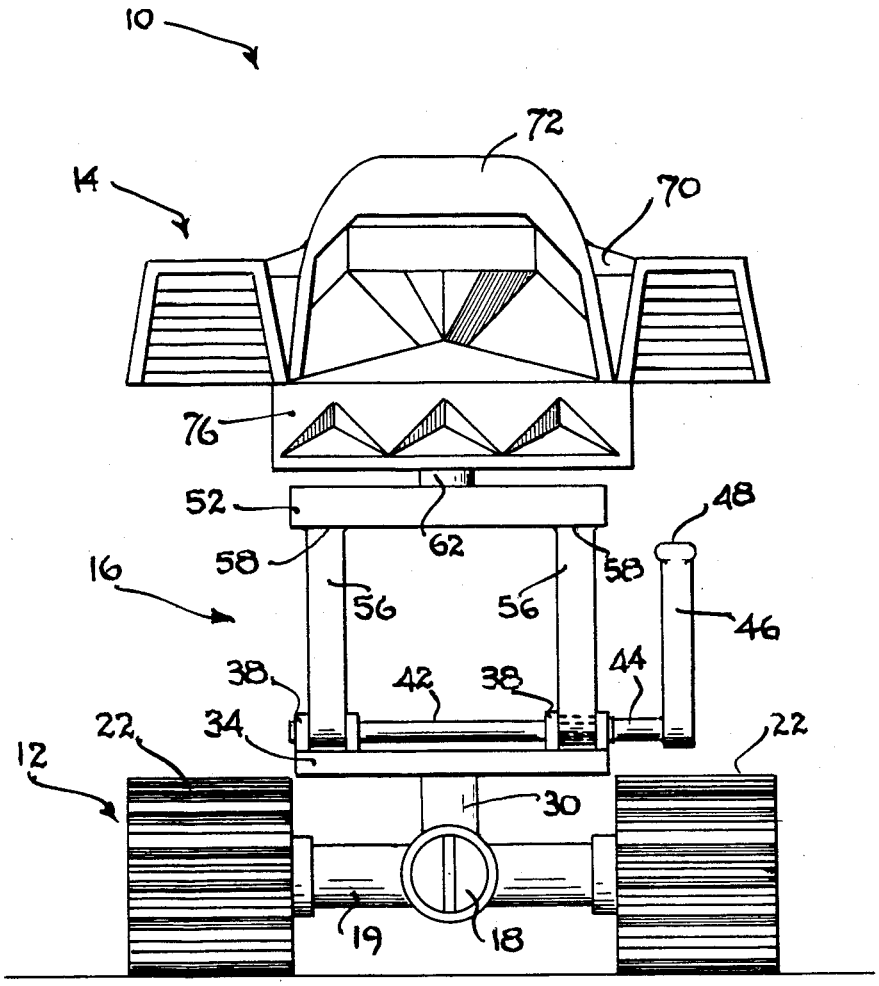
FIG. 2 is a front view of the vehicle shown in FIG. 1.
Figure 3:
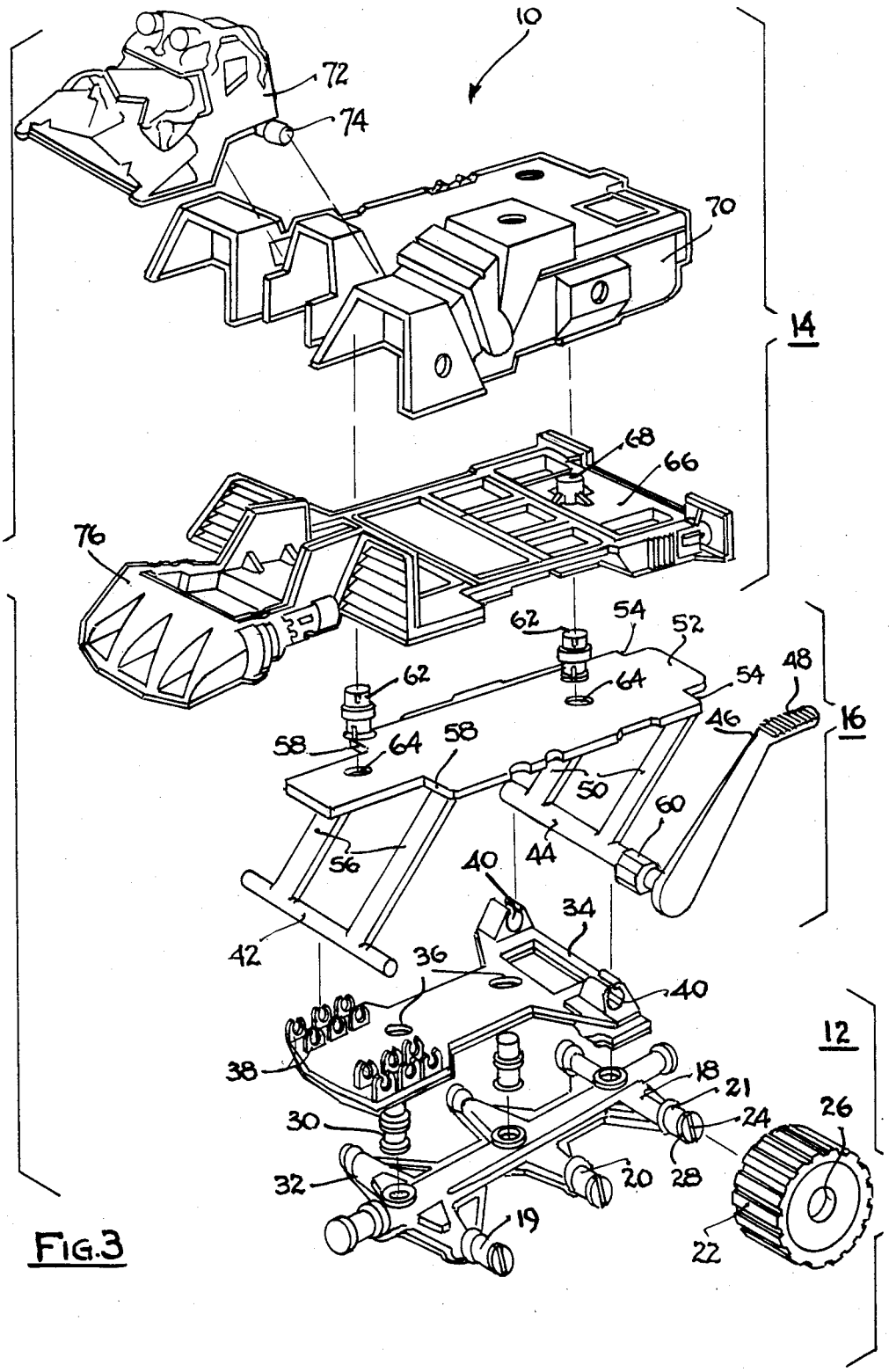
FIG. 3 is an exploded perspective view of the vehicle shown in FIG. 1.

Referring now to the Figures, there is shown a toy vehicle 10 constructed in accordance with the invention. The vehicle 10 includes a base portion 12 and an upper portion 14. A mechanical portion 16 links the base portion 12 to the upper portion 14.

The base portion 12 includes an axle platform 18 which may in the preferred embodiment be constructed from an injected molded plastic material as a single piece having three individual axles 19, 20, and 21 on each of which is mounted a wheel 22. Each of the axles 19, 20, and 21 is divided at a diameter at each of its outer ends by a slit 24. Each slit 24 progresses inwardly along the particular axle for a sufficient distance that a circular hole 26 in a wheel 22 may be forced over that particular axle and the wheel 22 retained in place by a lip 28 circumferentially positioned at the outer extremity of each end of each of the axles 19, 20, and 21. Thus, the axle platform 18 mounts six wheels 22 upon which the toy vehicle 10 may be moved.

Fixedly connected to the upper surface of the axle platform 18 is a mounting platform 34. The platform 34 may be connected by molded plastic fixtures 30 (which are well known in the art and therefore not described in detail herein) that project into circular receptor 32 in the axle platform 18. The platform 34 may be affixed to the fixtures 30 at circular holes 36. The platform 34 may also be constructed of a moldable plastic material as a single unit and have positioned thereon forward receptacle 38 and rear receptacles 40 shaped to receive rotating cylindrical members 42 and 44 of the mechanical portion 16. The receptacles 38 and 40 essentially provide hollow cylindrical channels having axes running parallel to the axes of the axles 19, 20, and 21 of the axle platform 18. These receptacles 38 and 40 are open at the top for the insertion of the cylindrical members 42 and 44 of the portion 16. The receptacles 38 and 40 are sufficiently malleable to allow the insertion of the members 42 and 44.

The mechanical portion 16 may also be constructed of a moldable plastic material such as polypropylene which conveniently allows hardy hinges to be constructed thereof simply by thinning the material even though the piece itself may be unitary. As is best shown in FIG. 4, the elements 42 and 44 are adapted to fit into the receptacles 38 and 40 so that they rotate therein. The element 44 has at its extreme end a lever 46 with a serrated upper surface 48 and is adapted to cause the rotation of the element 44 about its axis within the receptacles 40 upon the movement of the lever 46. The element 44 is connected by a pair of parallel arms 50 to a moving platform 52. The arms 50 are fixed to the outer circumference of the element 44 and run parallel to each other to the point at which each connects to the platform 52 at a thin webbing 54 which acts as a hinge. The platform 52 is connected to a second pair of arms 56 which run parallel from the outer circumference of the element 42 and connect to the platform 52 at a pair of webbings 58 which also act as hinges. The arms 50 and 56 are parallel to one another and of equal length in a preferred embodiment so that the rotation of the lever 46 about the axis of the element 44 causes each of the arms 50 to describe the radius of a circle about the axis of the element 44 and each of the arms 56 to describe the radius of a circle about the axis of the element 42. This causes the platform 52 to move in an upward and forward direction when the lever 46 is rotated from the right as shown in FIG. 1 upwardly to the left. In an alternative embodiment (which is not shown) a simple extension from one of the arms 50 is used to create a lever about the same axis of the element 44.

A portion 60 of the element 44 which fits into the receptacle 40 is in the preferred embodiment given a polygonal shape, and the inside surface of the particular receptacle (here labeled 61) is shaped to mate with that portion 60. This mating of surfaces provides a number of convenient stops so that the upper portion 14 may be placed in a number of different positions. It is also possible by creating an especially tight fit for the elements 42 or 44 within the receptacles 38, 38*a*, 38*b*, and 40 to cause the toy vehicle 10 to be able to assume a number of incremental positions each of which differs from the others thereby increasing the interest of the toy. Placing small teeth on the interior of the receptacles and the exterior of the elements 42 and 44 will accomplish the same purpose.

The platform 52 of the mechanical portion 16 is fixed to the upper portion 14 by a pair of fixtures 62 well known to the prior art and adapted to be positioned in holes 64 of the platform 52. In a preferred embodiment of the invention, the upper portion 14 includes a lower element 66 having circular openings 68 therein for insertion of the fixtures 62, an upper element 70, and a head element 72. Each of the elements 66, 70, and 72 may be constructed of a moldable plastic well known to the prior art in a shape such as to provide an exterior having characteristics selected to create the impression most desired for the particular vehicle. In the preferred embodiment, the head element 72 is connected by projections 74 to the forward portion of the upper element 70 in receptacles which provide pivots. This allows the head element 72 to be pivoted about the projection 74. The lower element 66 has a forward portion 76 shaped by molding to provide the appearance of a lower jaw so that the rotation of the head element 72 appears to open a mouth at the forward end of the toy vehicle 10. As may be seen in the Figures, the overall shape of the toy vehicle 10 is provided by the outer surface of the upper element 70, by the head element 72 and by the portion 76.

As will be understood by those skilled in the art the elements 66, 70, and 72 of the upper portion may be conveniently interchanged with other upper portions 14 molded into different shapes to provide different exterior chracteristics for the toy vehicle 10. This adaptability allows a single base portion 12 and a single mechanical portion 16 to be utilized in production of a number of different vehicles thereby lowering the overall cost of production.

In operation, the lever 46 of the toy vehicle 10 may be depressed causing the platform 52 to be lowered against the base portion 12 thereby lowering the upper portion 14 into what may appear to children to be a crouching position. When the lever 46 is released, the platform 52 will raise by itself on the arms 50 and 56 (which may be shaped like the legs of an imagined monster) because of the memory of the hinges 54 and 58 causing the toy vehicle 10 to appear to jump upwardly and forwardly. Alternatively, the lever 46 may be impelled about the axis of the element 44 in the forward direction of the toy vehicle 10 causing the vehicle to appear to jump upwardly and forwardly in a parody of a pounce. Such an action is adapted to provide an especial surprise in the enactment of the various fantasy worlds devised by children for the use of the toy vehicle 10. It should be noted that receptacles 38*a* and 38*b* are also provided on the surface of the mounting platform 34 so that the element 42 may be positioned at different distances from the element 44 to provide different movements than those provided by the basic parallelogram shape thereby enlarging the element of surprise for a child.

While a single example of the invention has been provided, it will be obvious to those skilled in the art that various modifications and additions may be made without departing from the spirit and scope of the invention. Consequently, it is intended that the invention be judged by the claims appended hereto.

What is claimed is:

1. A toy vehicle comprising a base portion; a top portion; and means linking the base portion to the top portion for causing the top portion to move to a number of different positions with respect to the base portion, the aforementioned means including a pair of pivoting axles, means for pivotably fixing the axles at selected positions adjacent the base portion, a pair of arms extending from each of the axles, each of the arms having an end, and means for pivotable fixing the ends of the arms extending from each axle to pivot at selected positions adjacent the top portion;

means for securing at least one of the axles in a number of rotational positions;

said means for securing at least one of the axles in a number of rotational positions comprises an exterior surface on the axle having a polygonal cylindrical shape, and a surface conforming to the flats of the shaped exterior surface of the axle affixed to the base portion.

2. A toy vehicle as claimed in claim 1 in which the means for pivotably fixing the axles at selected positions adjacent the base portion further includes means for varying the selected position of at least one of the axles.

3. A toy vehicle as claimed in claim 2 in which the means for pivotably fixing the axles at selected positions comprises receptacles fixed to the base portion, each receptacle having a surface for receiving one of the axles adapted to mate therewith.

4. A toy vehicle as claimed in claim 1 further comprising means linked to one of the axles for rotating that axle.

5. A toy vehicle as claimed in claim 4 in which the means linked to one of the axles comprises a lever arm linked to such axle.

* * * * *